United States Patent [19]

Bernardo

[11] 4,085,788

[45] Apr. 25, 1978

[54] REINFORCING MEANS FOR ROLL-UP SHUTTER

[76] Inventor: Richard Gregory Bernardo, 1230 S. Dixie Hwy., East, Pompano Beach, Fla. 33060

[21] Appl. No.: 701,953

[22] Filed: Jul. 1, 1976

Related U.S. Application Data

[63] Continuation of Ser. No. 546,039, Jan. 31, 1975, abandoned.

[51] Int. Cl.[2] ..... E06B 9/08

[52] U.S. Cl. ..... 160/133; 160/113; 49/57

[58] Field of Search ..... 160/133, 113, 201, 36, 160/89, 119; 292/338, 339; 49/56, 57

[56] References Cited

U.S. PATENT DOCUMENTS

| | | | |
|---|---|---|---|
| 1,420,932 | 6/1922 | Langeberg | 49/57 |
| 1,784,292 | 12/1930 | Johnson | 160/113 |
| 2,275,729 | 3/1942 | Casse | 160/113 |
| 2,794,217 | 6/1957 | Croft | 49/57 |
| 3,104,699 | 9/1963 | Wolf et al. | 160/201 |
| 3,195,615 | 7/1965 | Neisewander | 160/113 |
| 3,672,098 | 6/1972 | Webb, Jr. et al. | 160/113 |
| 3,732,913 | 5/1973 | Wrono | 160/133 |
| 3,853,166 | 12/1974 | Wrono | 160/133 |

FOREIGN PATENT DOCUMENTS

| | | | |
|---|---|---|---|
| 602,400 | 2/1960 | Italy | 160/133 |

*Primary Examiner*—Paul R. Gilliam
*Assistant Examiner*—Victor N. Sakran
*Attorney, Agent, or Firm*—Eugene F. Malin; Barry L. Haley

[57] ABSTRACT

A reinforcing means for a closure having a slatted, articulated, shutter for openings in a wall of a building, in the form of a readily detachable beam disposed in close proximity with the shutter. The lower end of the beam is attached to the frame of the closure, and the upper end of the beam is received within a slotted member attached to a wall of the building.

9 Claims, 5 Drawing Figures

REINFORCING MEANS FOR ROLL-UP SHUTTER

This is a continuation of application Ser. No. 546,039, filed 1/31/75 now abandoned.

BACKGROUND OF THE INVENTION

1. Field of the Invention:

This invention relates to closures, and more particularly to an improvement in a slatted, articulated, shutter of the roll-up type adapted to be installed in openings in buildings, for example, porch and patio openings, and window and door openings.

2. Description of the Prior Art:

Shutters of the roll-up type are usually made from a plurality of relatively thin, articulated, slats, the slats being arcuate in cross section, each slat being hingedly connected with an adjoining slat. The shutter is coiled about a roller similar to the type employed in window shades in which a helical spring urges the shutter to a raised position. Opposite ends of the slats are guided in a pair of track channels, forming a part of the closure frame.

Closures of this type are purposely made of thin, light-weight, slats, usually of aluminum, for ease in operation. The slats are usually disposed in a horizontal direction. For relatively narrow openings, the construction can withstand moderate winds. However, in the case of wide openings provided in patios and porches, and as a safeguard against strong winds, reinforcing means are sometimes provided.

Such reinforcing means are usually of two types. In one type reinforcing bars are associated with and movable with the slats. This type of construction is objectionable because it adds considerably to the cost of construction and to the weight of the shutter.

Another form of reinforcing means employed involves the provision of a structure in the rear of the shutter and in close proximity therewith. When used in a window opening, the shutter is mounted to slide vertically a distance in front of the window, and there is usually sufficient space between the shutter and the window for mounting of such a reinforcing structure.

The use of a permanent reinforcing frame structure is objectionable because of its appearance.

Attempts have been made to provide a removable reinforcing structure. These attempts have not met with success for two reasons: (1) they are too complicated and costly; and (2) they are difficult to mount and to remove. When used in an installation wherein a roll-up shutter is mounted in front of a single or double hung window, a person working from the inside of the building and attempting to remove or to install the reinforcing structure has only one-half of the window opening to work through. This requires that he must roll up the shutter and work from the outside of the building, and if the window is high above the ground, he must use a ladder. In the case of inclement weather, this can not only become a nuisance, but a hazard.

SUMMARY OF THE INVENTION

It is an object of this invention to provide a novel reinforcing means for a roll-up shutter which obviates all of the above mentioned objectionable features.

It is a further object of this invention to provide a novel reinforcing means for a roll-up shutter that can be easily and quickly installed and removed from the inside of the opening in the building wherein the shutter is mounted.

It is a still further object of the invention to provide a novel reinforcing means for a roll-up shutter that can be installed and removed without rolling up the shutter if it is in its lowermost position, or without lowering the shutter if it is in its uppermost position.

It is a still further object of the invention to provide a novel reinforcing means for a roll-up shutter that is economical to manufacture and which can be made from readily available parts.

The attainment of the above and other objects and advantages is accomplished by a novel construction in which a beam, which can be an H, I or T in cross section, is removably mounted behind the roll-up shutter in close proximity with the shutter.

As used in the specification and claims, the term "opening in a wall of a building" has reference to any opening in a building proper, or in an opening provided about a porch or patio of a building. This includes window and door openings, and in the case of patios and porches, the space between the floor and ceiling or a skirt attached to the ceiling or roof, and to any openings provided in tubular frame structure, usually made from extruded aluminum, constructed from members disposed horizontally and/or parpendicularly to form a plurality of openings to accommodate screens or shutters.

The roll-up shutter, per se, is of a type well known in the art, exemplified in a U.S. Patent to Wrono, No. 3,732,913, in which an articulated, slatted, shutter is mounted on a roller to be raised and lowered as desired. The roller is loaded by a helical spring, in the same manner as the conventional window shade, to facilitate the raising of the shutter to an uppermost position.

The invention provides a novel reinforcing device adapted to be mounted on the inside and in close proximity with the slats when in their lowered position, consisting of a beam, which may be in the form of an H, I or T in cross section, having connecting means whereby the beam can be supported in position. These connecting means are of a type that can be quickly and easily disconnected, to permit the reinforcing device to be placed in position and removed as desired.

BRIEF DESCRIPTION OF THE DRAWINGS

For a clearer understanding of the invention and its operation, reference is made to the following detailed description and to the annexed drawings, in which.

DESCRIPTION OF A PREFERRED EMBODIMENT

Referring to the annexed drawings illustrating a preferred embodiment, the numeral 10 designates a closure in a building. As used in the specification and claims, the term "opening in a wall of a building" is used in a broad sense to define any opening allowing air and light to enter a building or an adjunct thereto, such as a door, window, and the outer space between the floor and the ceiling of a porch, patio, apartment house terrace and the like. The term "wall of the building" is also used in a broad sense and includes the side, top and bottom walls of a window or door, and the ceiling and floor of a porch and patio, and the walls of the building adjacent thereto. It is a common practice to provide shutters as closures for such openings, and a roll-up shutter is one type of shutter frequently employed.

The opening in the building is designated by the numeral 12, and for purposes of illustration but by no means to be taken as a limitation, is shown as a porch or patio opening in which the ceiling is designated by 14 and the floor as 16.

The openings 12 in the case of patios and porches are generally extended laterally, and can accommodate a number of shutter units disposed in side-by-side relation.

Figure 1:
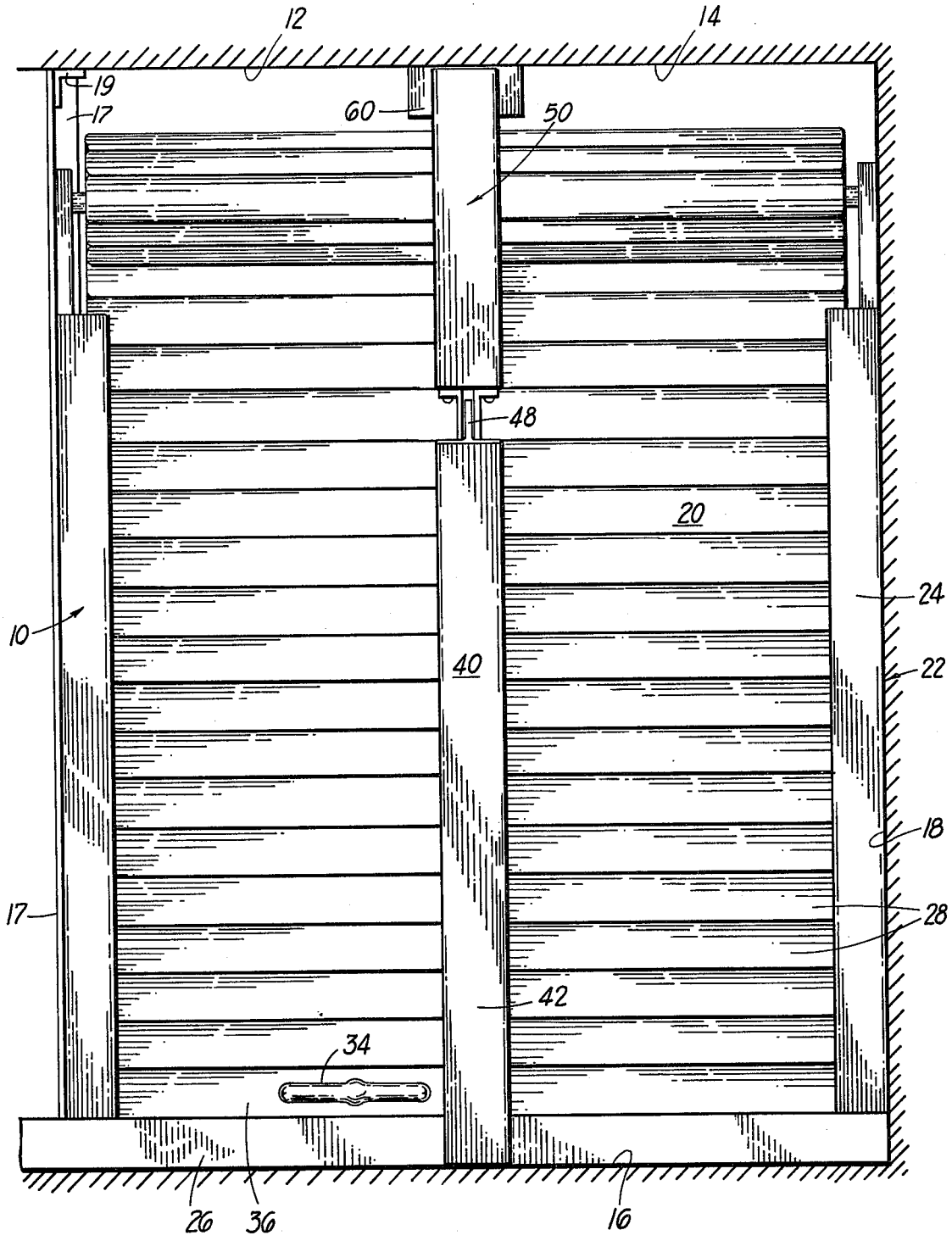
FIG. 1 is an elevation view of a roll-up shutter assembly as seen from the inside of a building, illustrating my novel reinforcing means in position.

A single roll-up shutter unit is shown in FIG. 1 and designated in its entirety by the numeral 20. If a pair of such units are disposed in adjoining relation, the web of a T-bar 17 is placed between them, the frame of each unit being attached to the T-bar, and the upper end of the T-bar being attached to the ceiling 14 by means of an angle member 19.

If the shutter unit 10 is attached to the wall 18 of the building, an angle bar, not shown, can be used.

Where a pair of shutter units 10 are mounted on opposite sides of a corner of an opening in a building, it is obviously necessary to provide a space between such units to accommodate the rollers of the shutters. In such an installation, a panel, extending from the floor to the ceiling, is installed between the shutter units, being attached to the angle bar and to the shutter frame. The above described installations are conventional, and further detailed description thereof appears to be superfluous herein.

Figure 2:
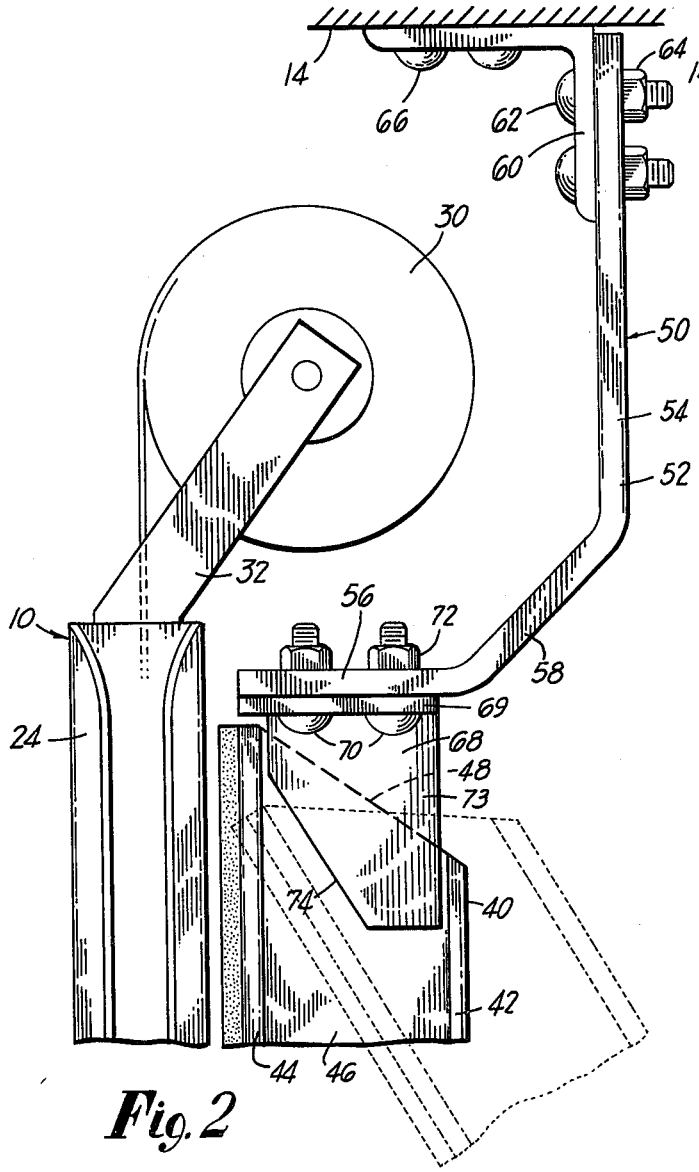
FIG. 2 is an enlarged detail view of the upper end of the roll-up shutter and reinforcing means, showing a side view of the latter.

The roll-up shutter illustrated herein is of a conventional type, and comprises a frame 22 including a pair of opposed, vertically extending, guide channels or tracks 24 adapted to receive the ends of the slats of the shutter. As shown in FIG. 2, the upper end of the channels is flaired to allow the slats to freely enter the channels.

The frame also includes a base plate strip in the form of an angle member 26 which is attached to the floor or the top of a railing 16 by means of a plurality of spaced lag bolts or screws 27, the angle member 26 extending the full length of the opening to be covered with the closures 10. The vertically extending channels 24 are attached to the base plate strip 24 by conventional means, not shown, forming no part of the present invention.

The roll-up shutter 20 includes a series of interconnected, articulated, slats 28 adapted to be coiled about a roller 30. This roller includes a helical wind-up spring, similar to that employed on roll-up window shades, urging the slatted structure to a raised position. The roller 30 is supported by a pair of brackets 32 attached, at their lower ends, to the upper ends of the channels or tracks 24. A handle 34, attached to a cross bar 36, facilitates the raising and lowering of the shutters in an obvious manner. The cross bar 36 is attached to the lowermost slat 28.

Roll-up shutters of this type are exposed to the ambient winds. For ease in operation, the slats are usually made from thin aluminum strips. Such construction has been found to be satisfactory for moderate breezes, but sometimes inadequate in the event of strong gusts, especially in the case of relatively wide shutters. Moreover, stronger gusts frequently create undesirable rattling. Cushioning means are commonly employed within the track channels 24 to dampen rattling.

As a protection against destructive wind forces and undesirable rattling of the slats, my invention comprises a reinforcing means adapted to be removably installed on the inside of the closure and in close proximity with the slats. The reinforcing means may be in the form of a beam 40, in the shape of an I, T or H in cross section, having, in the form illustrated, a pair of flanges 42 and 44 and an interconnecting web 46. As illustrated in FIG. 2, the upper end of the flange 42 and the web 46 is cut away at an angle to form a sloped surface or taper 48 for a purpose to be explained later herein.

The upper end of the beam 40 is joined with the ceiling 14 of the building by a first attaching means 50 comprising an angled connecting member 52 having a vertical section 54, a horizontal section 56, and an intermediate section 58, the latter being disposed at an angle of 45° relative to the longitudinal axes of the sections 54 and 56. The object of this angled construction is to permit attachment of one end of the attaching means 50 to the ceiling 14 and the other end to the upper end of the reinforcing means 40, to dispose the latter in close proximity with the slats 28 when in their lowered position, and providing space to accommodate the roller 30. While an angular construction is disclosed, it is obvious that an arcuate construction, or a combination of angles and arcs can be used to accomplish the same result.

An angle member 60 is attached to the upper end of the vertical section 54 by means of a plurality of bolts 62 and nuts 64, and the angle member is attached to the ceiling 14 by a plurality of lag bolts or screws 66.

Figure 3:
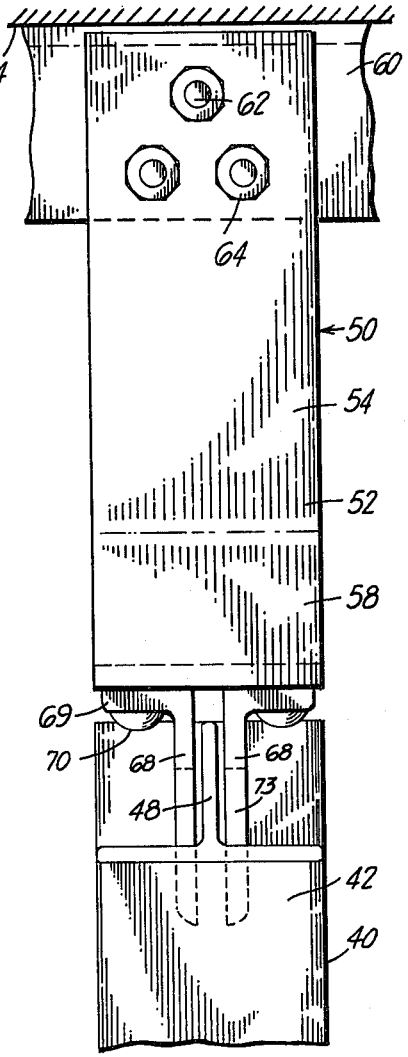
FIG. 3 is an enlarged detail view of the reinforcing means as seen from the inside of the building in which it is installed.
Figure 4:
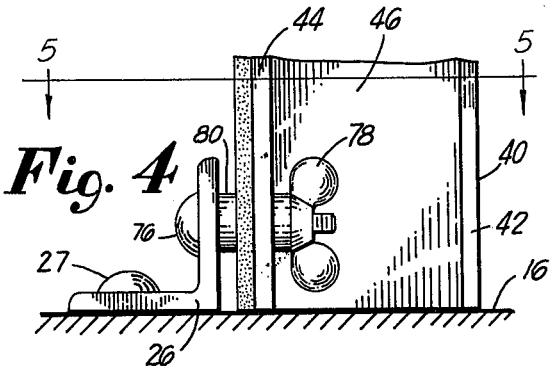
FIG. 4 is an enlarged detail view of the lower end of the reinforcing means showing its connection with a portion of the frame of the roll-up shutter, as seen from the side.
Figure 5:
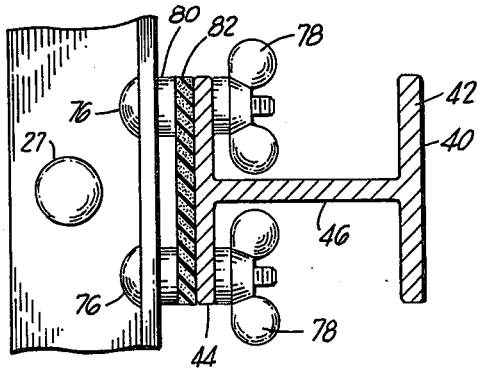
FIG. 5 is a sectional view through the reinforcing means, taken on the line 5—5 of FIG. 4 looking in the direction of the arrows.

A pair of angle members 68 are attached to the horizontal section 56, flanges 69 of the members 68 being attached to the section 56 by a plurality of bolts 70 and nuts 72 in a position to dispose the flanges 73 in spaced relation, as shown in FIG. 3, to form a slotted means adapted to receive the web 46 of the beam 40. The flanges 73 of the angle members 68 are longer than the flanges 69, and are cut away at an angle to form a sloped surface or taper 74, to facilitate the installation and removal of the reinforcing beam 40.

A second attaching means for the reinforcing beam 40 comprises a pair of bolts 76 adapted to pass through aligned apertures in the base plate strip 26 and the flange 44 of the reinforcing beam 40 on opposite sides of the web 46, and a pair of wing nuts 78. Spacing washers 80 disposed between the flange 44 and the vertical flange of the base plate strip 26 maintain the reinforcing beam 40 in proper spaced relation relative to the base plate strip 26.

A cushioning means 82, in the form of an elastomeric tape or a felt strip, is disposed on the outer surface of the flange 44 facing the slats 28 of the roll-up shutter, to avoid any rattling noise that might result from the slats striking against the flange 44 of the beam 40.

Since the reinforcing beam 40 is required only in the event of strong winds, it can be quickly and easily removed and installed when necessary.

For removal, the wing nuts 78 are removed from the bolts 76, and the lower end of the beam 40 is swung inwardly about 30° or so as shown in broken lines in FIG. 2, whereby the upper end of the beam is lowered sufficiently to permit the removal of the web 46 from the slotted means 68, the tapers or slopes 48 and 74 on the web and the flanges 73 of the angle members 68 permitting the easy and quick removal. For installations, an opposite procedure is followed.

From the foregoing, it is evident that I have devised an inexpensive and a simple reinforcing means for a roll-up shutter and the like, which can be easily and quickly installed and removed by a person standing on the inside of the opening. In the case of high ceilings, there is no problem of reaching upwardly to make connections. The beam is made from extruded aluminum and is light in weight, requiring only that one must reach toward the floor to remove one or two wing nuts. The bolts 76 can be removed also, if desired, or can be made of a type that can be permanently attached to the upstanding flange of the base plate strip 26.

The above description of a preferred embodiment discloses and describes the invention applied to a roll-up shutter installed between the floor and ceiling of a porch or patio, one side of the frame 22 being attached to a wall of the building, and the opposite side of the frame being attached to a similar shutter unit with an intermediate T-bar 17. In the event of an installation in a window or door opening, or any opening in a building wherein there is a skirt depending from the ceiling, the attaching means for the upper end of the reinforcing beam may be secured to the upper wall of the door or window, or to the lower end of the skirt, or to an inside wall of the building adjacent the opening.

In the use of a T-bar or T-beam, it is evident that the flange or crossing of the T must be disposed on the outside of the frames.

It should be understood that while only one preferred embodiment of the invention has been described in detail, variations and modifications thereof are contemplated without departing from the basic spirit of the invention within the scope of the appended claims.

I claim:

1. In combination with a roll-up shade closure assembly mounted within an opening in a wall of a building, said closure assembly in said opening includes side frames, a floor frame connected to said side frames, and an articulated, horizontally slatted, roll-up shutter connected adjacent the top of said side frames, and said opening having a top barrier portion, side walls, and a bottom barrier portion; a detachable interlocking vertically disposed reinforcing beam with an upper end portion and a lower end portion disposed in said opening in close proximity with said shutter; first means permanently connected to said top barrier portion for detachably interlocking the upper end of said beam to said top barrier portion of said building; and second means for locking the other end of said beam to said frame.

2. The combination recited in claim 1, in which said beam comprises at least one flange and a web connected to said flange.

3. In combination with a roll-up shade closure assembly mounted within an opening in a wall of a building, said closure assembly in said opening including a frame and an articulated, slatted, roll-up shutter, and said opening having a top barrier, side walls, and a bottom barrier; a detachable reinforcing beam disposed in said opening in close proximity with said shutter, said beam comprises at least one flange and a web connected to said flange; first means attaching one end of said beam to a wall of said building, said first attaching means includes a connecting member, a slotted means carried by said connecting member, and means securing one end of said connecting member to a wall of said building, said web being received within said slotted means; and second means attaching the other end of said beam to said frame.

4. The combination recited in claim 3, in which said connecting member is an angled plate having a vertical portion secured to said means securing said connecting member to said top barrier, a horizontal portion positioned beneath a portion of said roll-up shutter and having said slotted means attached thereto, and an intermediate portion.

5. The combination recited in claim 3, in which said web of that end of said beam received within said slotted means is tapered, and the walls of said slotted means are oppositely tapered to facilitate the entry of said web of said beam within said slotted means.

6. The combination recited in claim 5, including cushioning means carried by a flange of said beam on the side adjacent the roll-up shutter.

7. The combination recited in claim 6, in which said frame includes an angle-shaped member, said second attaching means being adapted to pass through aligned apertures in said angle-shaped member and said flange of said beam and said first means projects a relatively short distance from said top barrier portion having the same general longitudinal center line as said beam.

8. In combination with a roll-up shade closure assembly mounted within an opening in a wall of a building, said closure assembly in said opening includes side frames, a floor frame connected to said side frames, and an articulated, horizontally slatted, roll-up shutter connected adjacent the top of said side frames, and said opening having a top barrier portion, side walls, and a bottom barrier portion; a detachable interlocking vertically disposed reinforcing beam with an upper end portion and a lower end portion disposed in said opening in close proximity with said shutter; first attaching means includes a connecting member, a slotted means carried by said connecting member and means securing one end permanently to said top barrier portion between said side frames for detachably interlocking said upper end of said beam to said top barrier portion of said building and second means for locking said lower end of said beam to said floor frame, said beam solely supported by said first means and second means to provide additional independent support of the shutter.

9. In combination with a closure mounted within an opening in a wall of a building, said closure including a frame and an articulated, slatted, roll-up shutter, and said opening having a top wall, side walls, and a bottom wall; a detachable reinforcing beam disposed in said opening in close proximity with said shutter, said beam comprises at least one flange and a web connected to said flange, said web being tapered at one end; first means attaching one end of said beam to a wall of said building, said first attaching means includes a connecting member including a vertical portion secured to said means securing said connecting member to said top barrier, a horizontal portion, and an intermediate portion, a tapered slotted means carried by said horizontal portion, and means securing said vertical portion of said connecting member to said top wall of said building, said tapered web being received within said tapered slotted means; and second means attaching the other end of said beam to said frame.

* * * * *